US006609264B2

(12) United States Patent
Ruhl et al.

(10) Patent No.: US 6,609,264 B2
(45) Date of Patent: Aug. 26, 2003

(54) PUMP CYCLING CONTROL SYSTEM FOR A WASHING MACHINE

(75) Inventors: Craig S. Ruhl, Altoona, IA (US); Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 92 days.

(21) Appl. No.: 09/956,894

(22) Filed: Sep. 21, 2001

(65) Prior Publication Data

US 2003/0056300 A1 Mar. 27, 2003

(51) Int. Cl.[7] ..... D06F 33/02

(52) U.S. Cl. ..... 8/158; 68/12.02; 68/12.05; 68/12.12; 68/12.21; 68/23.4; 68/208

(58) Field of Search ..... 8/158; 68/12.02, 68/12.05, 12.12, 12.14, 12.19, 12.21, 23.4, 208

(56) References Cited

U.S. PATENT DOCUMENTS

| | | | |
|---|---|---|---|
| 3,526,105 | A | 9/1970 | Anthony |
| 4,662,193 | A | 5/1987 | Honda |
| 5,325,677 | A | 7/1994 | Payne et al. |
| 5,361,439 | A | 11/1994 | Malchow |
| 5,596,889 | A | 1/1997 | Guerra et al. |

FOREIGN PATENT DOCUMENTS

| | | |
|---|---|---|
| EP | 553645 | 8/1993 |
| JP | 1-175887 | 7/1989 |
| JP | 5-76687 | 3/1993 |

*Primary Examiner*—Philip R. Coe
(74) *Attorney, Agent, or Firm*—Diederiks & Whitelaw, PLC

(57) ABSTRACT

A drain pump of a washing machine is cyclically activated during a drain operation conducted as part of a spin cycle in a manner which reduces the run time of the pump. At least one dynamic operating parameter of the washing machine is sensed and used to control the operation of the drain pump. In accordance with a preferred embodiment of the invention, the rotational speed of the wash tub is sensed and, when a predetermined spin speed is maintained for a prescribed period of time, the drain operation is initiated. Water level, pump power and/or drive motor torque can also be utilized as pump cycling control parameters.

18 Claims, 3 Drawing Sheets

PUMP CYCLING CONTROL SYSTEM FOR A WASHING MACHINE

BACKGROUND OF THE INVENTION

1. Field of the Invention

The present invention pertains to the art of washing machines and, more particularly, to a pump cycling system for controlling a drainage operation in a washing machine.

2. Discussion of the Prior Art

During operation, a clothes washing machine proceeds through a series of wash and rinse cycles. At least a terminal portion of each rinse cycle includes a spin cycle portion wherein a clothes article containing tub or basket is spun at a relatively high speed in order to extract water from the clothes. During the spin cycle, a drain pump is typically run full time in order to remove water from the washer. For a substantial portion of the spin cycle, the rate at which water is removed from the clothes is much lower than the rate that the pump can function. This results in the pump working in a mixture of air and water. Such operating conditions can cause premature wear on the pump, as well as developing excessive noise.

To address these concerns, various systems have been proposed which function to limit the operating time of a washing machine drain pump. For instance, it has been proposed in the art to activate the drain pump for only a prescribed percentage of the spin cycle, during intermittent, predetermined periods throughout the cycle, for a timed duration which can vary with wash load, or simply based on a sensed water level within the machine. Although these systems aid in addressing the problems noted above, excessive pump operation times still exist in accordance with these prior art arrangements, particularly in connection with the timed pump operation based systems. Based on at least these reasons, there is a need in the art for a control system which will effectively and efficiently reduce the cycle time of a drain pump in a washing machine.

SUMMARY OF THE INVENTION

The present invention is directed to a system and method for effectively controlling the time a drain pump of a washing machine is activated during a drain operation conducted as part of a spin cycle. In accordance with the invention, at least one dynamic operating parameter of the washing machine is sensed and used to control the activation and deactivation of the drain pump in a cyclic manner.

In accordance with the most preferred form of the invention, activation of the drain pump is dependent upon extraction speed and time. More particularly, the spin speed of the washing machine tub is monitored and when this speed has dwelled at a specified speed for a predetermined amount of time, a controller is employed to automatically cycle the drain pump for a prescribed time period. In accordance with a second embodiment of the invention, the torque employed to drive the washing tub during a spin cycle is monitored to trigger a drain operation. That is, a sensed increase of torque to the washing tub is indicative of the presence of an excess of water. As the torque decreases, the pump is cycled off. These control arrangements can actually be employed individually or in combination in accordance with the invention. Furthermore, input from a water level sensor could be used in connection with an additional, redundant system, i.e., as a verification measure for use in combination with one or more of the dynamic based pump cycle time control systems of the invention.

Based on the above, it should be apparent that the system of the present invention relies upon one or more specific dynamic variables of the washing machine in order to accurately and effectively control the operation of the drain pump so as to minimize cycle times. In any event, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
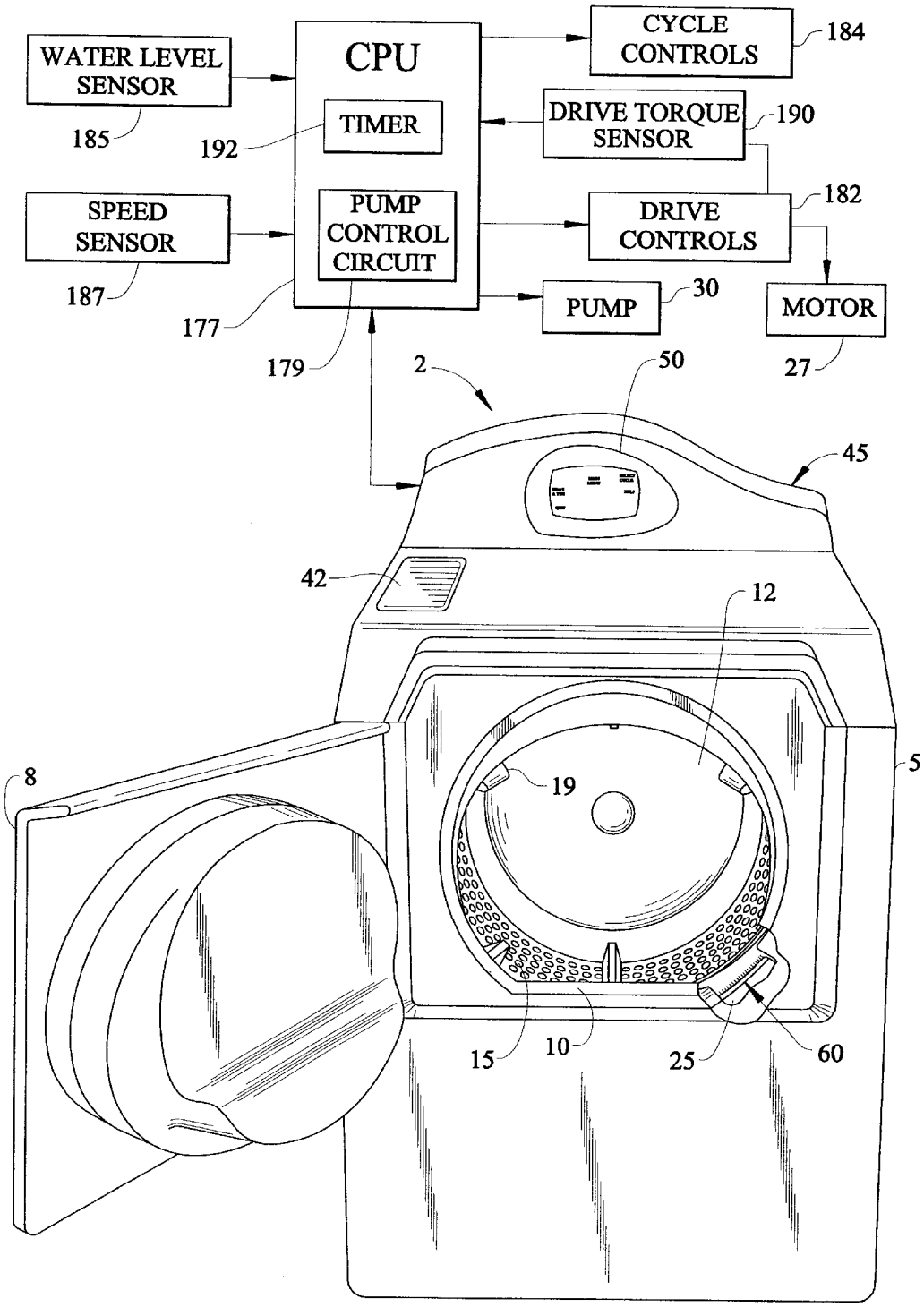
FIG. 1 is a partially cut-away, perspective view of a horizontal axis washing machine incorporating a pump cycling control system according to the invention.

With initial reference to FIG. 1, an automatic horizontal axis washing machine incorporating the pump cycling control system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

Figure 3:
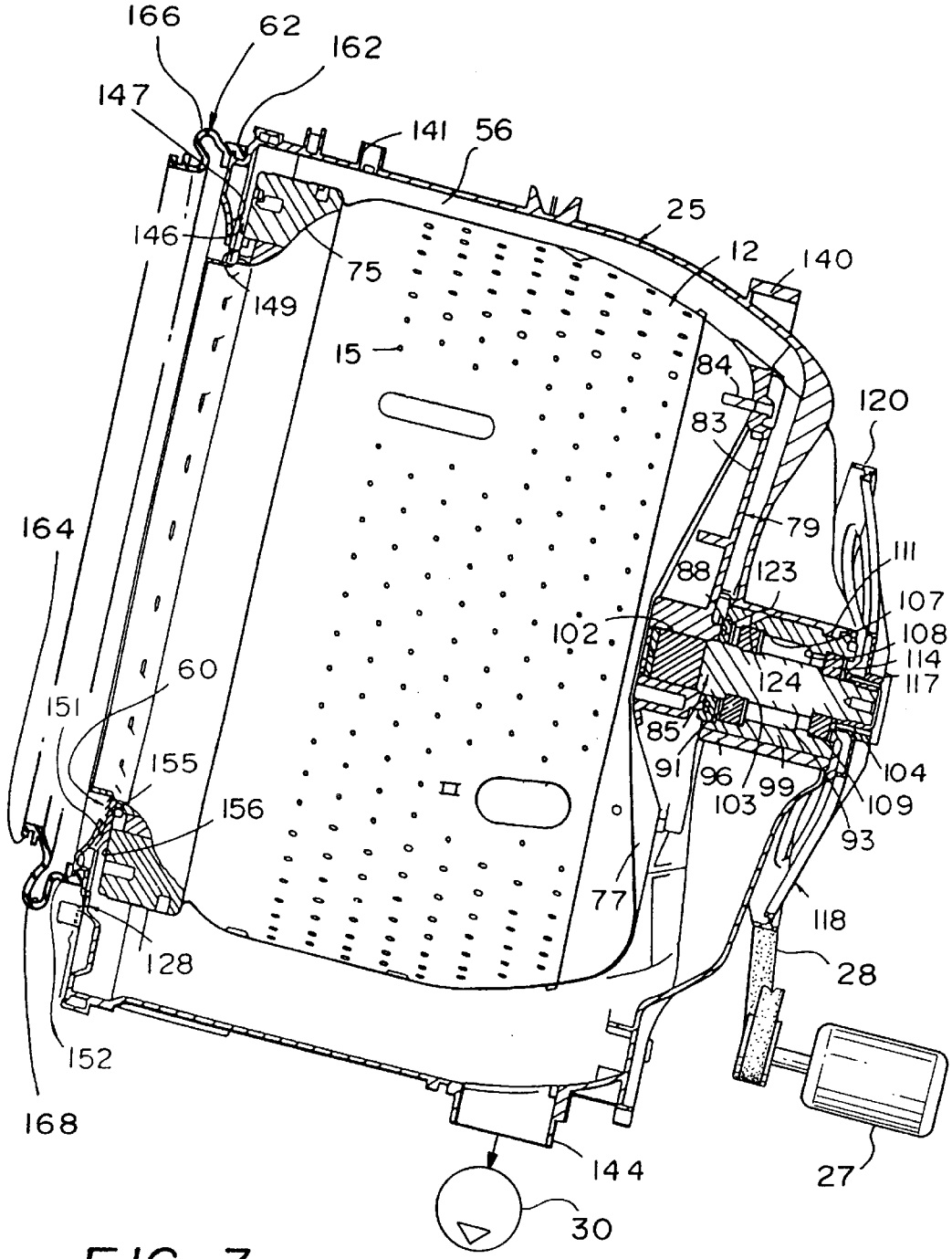
FIG. 3 is a cross-sectional view of the internal components of FIG. 2 in an assembled state.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. A motor 27, preferably constituted by a variable speed, reversible electric motor, is mounted within cabinet shell 5 and adapted to drive inner tub 12 through belt 28. More specifically, inner tub 12 is rotated during both wash and rinse cycles such that articles of clothing placed therein actually tumble through either water, water/detergent or another washing fluid supplied within inner tub 12. Given that inner tub 12 is provided with at least the plurality of holes 15, the water or water/detergent can flow between the inner and outer tubs 12 and 25. A pump 30 (see FIGS. 1 and 3) is provided to control the level of washing fluid within machine 2, particularly the draining of the fluid from outer tub 25. As will be detailed more fully below, the present invention is particularly directed to the manner in which pump 30 is operated so as to reduce cycling times.

The general manner in which the automatic washing machine 2 of FIG. 1 operates is well known in the art and is not considered an aspect of the present invention. Therefore, a full description of its operation will not be described here. However, for the sake of completeness, automatic washing machine 2 is also shown to include an upper cover 42 that provides access to an area for adding detergent, softeners and the like. In addition, an upper control panel 45, including an LCD display screen 50, is provided for manually establishing a desired washing operation. In the preferred embodiment shown, display 50 includes a plurality of selectable control areas or zones which can be accessed by a user to both program and operate washing machine 2. In the most preferred form of the invention, display 50 takes the form of an LCD display, such as a 128× 96 dot matrix, touch screen display, which enables a user to readily review displayed data, preferably in alpha or word text format, and select from that data to establish and begin a desired washing operation. Display 50 could have the selectable areas at any location on the display. The manner in which washing machine 2 can be programmed is disclosed in U.S. Patent Application Ser. No. 09/741,067 entitled "Interactive Control System for a Laundry Appliance", filed on Dec. 21, 2000, now U.S. Pat. No. 6,502,265, and incorporated herein by reference.

Figure 2:
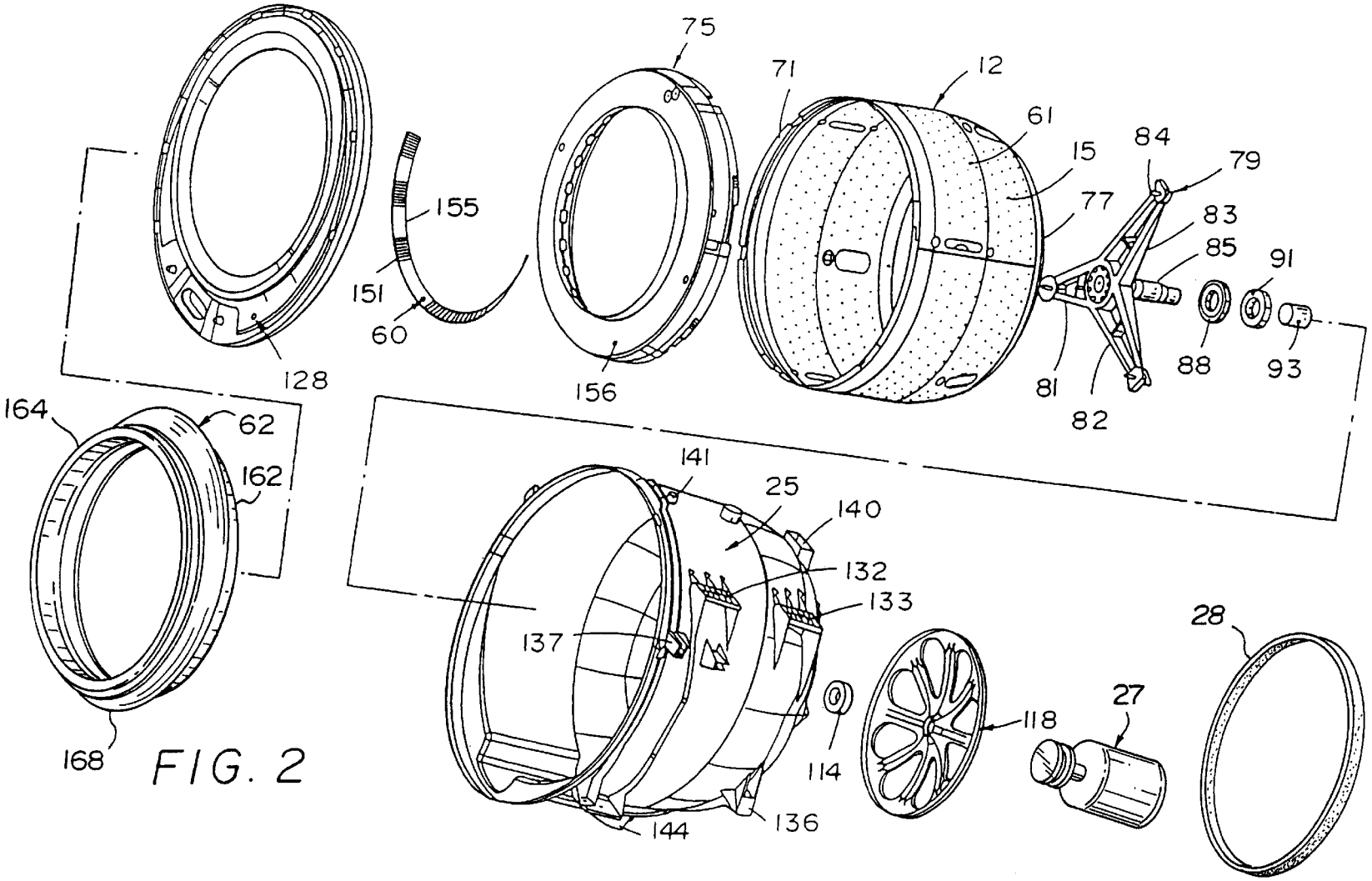
FIG. 2 is an exploded view of various internal components of the washing machine of FIG. 1.

As best seen in FIGS. 2 and 3, in order to allow inner tub 12 to freely rotate within outer tub 25 during a given washing operation, inner tub 12 is spaced concentrically within outer tub 25. This spacing establishes an annular gap 56 between the inner and outer tubs 12 and 25. As will be discussed fully below, an axial gap is also created at the open frontal portions of inner and outer tubs 12 and 25. During operation of washing machine 2, the washing fluid can flow through gap 56 from inner tub 12 into outer tub 25. In addition, small objects can also flow into the outer tub 25 through the axial gap. Unfortunately, it has been found in the past that some objects flowing through the axial gap can end up clogging or otherwise disrupting the normal operation of the pumping system, thereby leading to the need for machine repairs. In order to remedy this situation, it has been heretofore proposed to incorporate a flexible sealing device, generally indicated at 60 in FIGS. 1 and 3, which functions to bridge this gap between inner and outer tubs 12 and 25 to prevent such objects from flowing into the outer tub 25. Further provided as part of washing machine 2, in a manner known in the art, is a sealing boot 62 which extends generally between outer tub 25 and a frontal panel portion (not separately labeled) of cabinet shell 5.

Reference now will be made to FIGS. 2 and 3 in describing the preferred mounting of inner tub 12 within outer tub 25 and the arrangement of both sealing device 60 and sealing boot 62 as the tumble cycle feature of the present invention is related to the presence of one or more of these structural elements. Inner tub 12 has an annular side wall 61 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to belt 28 driven in a controlled fashion by the reversible motor 27 in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above.

Furthermore, outer tub 25 is formed with a drain port 144 which is adapted to be connected to pump 30 for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25.

Flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed sealed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a lower trough 168.

In general, various wash cycles can be selected through display 50, including "Normal", "Extra Rinse" and "Stain Removal" cycles. During a normal washing operation, automatic washing machine 2 will proceed through a main wash cycle and a predetermined number of rinse cycles. In the main wash cycle, a preset amount of water is added to any detergent or other washing solution supplied in the areas beneath cover 42 and inner tub or spinner 12 is driven to tumble articles of clothing through the resulting solution. Periodically, it is preferable to alter the rotational direction of inner tub 12 during this period to vary the tumbling pattern.

After the wash cycle tumbling time period has elapsed, a drain cycle is initiated with a continued tumbling action. In the preferred embodiment, this tumble drain period lasts approximately 90 seconds. Following the tumble drain, inner tub 12 is subjected to a spin mode wherein inner tub 12 spins for approximately two minutes. At this point, the water/detergent solution has been substantially removed from within inner tub 12, although the articles of clothing will certainly still possess a certain percentage of the solution. Next, the articles of clothing are subjected to the predetermined number of rinse cycles wherein inner tub 12 is filled to a predetermined level with water and placed in a rinse cycle tumble pattern. In the most preferred form, three rinse cycles are provided. In general, each of the rinse cycles sequentially incorporate a rinsing tumble mode, followed by a tumble drain, a pause drain and then a rinse cycle spin mode. Thereafter, a final draining occurs and inner tub 12 is allowed to coast to a stop position and the washing operation is completed. Further details of this overall operational sequence is described in commonly assigned U.S. Pat. No. 6,241,782 entitled "Horizontal Axis Washing Machine Incorporating Flush Tumble Cycle" issued Jun. 5, 2001, which is hereby incorporated by reference.

Washing machine 2 includes a central processing unit (CPU) 177 used to regulate tub drive controls 182 for motor 27, cycle controls 184, and pump 30. As indicated above, the present invention is directed to the manner in which pump 30 is controlled in order to reduce cycling times. Therefore, until this point, the basic structure of washing machine 2 as described above is known in the art and has been described both for the sake of completeness and to provide support for the pump control system of the present invention which will now be described in detail.

As shown in FIG. 1, central processing unit (CPU) 177 incorporating a pump control circuit 179 used to regulate the operation of pump 30. As also shown, CPU 177 is adapted to receive signals from a water level sensor 185, an inner tub speed sensor 187 and a drive torque sensor 190 for motor 27. During a spin or extraction phase of a washing operation, inner tub 12 is adapted to be rotated at increasingly high speeds. In accordance with the invention, when a predetermined speed is reached, pump 30 is activated. For instance, in the most preferred form, horizontal axis washing machine 2 is adapted to reach a final extraction speed of 800 rpm which is monitored by sensor 187. Of course, the extraction speeds during other portions of the washing operation can vary and, accordingly, so will the threshold level for activation of pump 30. In any event, when a signal of 800 rpm is received by CPU 177, a timer 192 is initiated. If sensor 187 continues to indicate 800 rpm for one minute, pump control circuit 179 is used to cycle pump 30. Therefore, the drain operation is performed when inner tub 12 reaches a constant, predetermined rotational velocity for a set period of time. In the most preferred form of the invention, pump control circuit 179 functions to cycle pump with a 15 second ON and 30 second OFF basis. This cycling operation continue until sensor 187 indicates a drop in the speed. Since this represents the final extraction or spin phase of the overall washing operation, at this point, the entire washing machine 2 would be turned off. However, it should be recognized that a corresponding cycling of pump 30 is performed in connection with each spin cycle, although the threshold speed will vary.

At this point, it should be readily understood that various changes and/or modifications can be made to the invention without departing from the spirit thereof. For instance, it is contemplated that pump 30 could be activated in the manner set forth above, while being deactivated based on other criteria. For instance, the power sent to pump 30 could be monitored. Based upon changes in the amount of power needed to operate pump 30, pump 30 would be de-activated. That is, when the water level diminishes, the flow in pump 30 will be a combination of air and water. The power require to pump this combination would be significantly lower than just water. Therefore, a reduction in the operation of pump 30 under this condition would be warranted.

In a similar fashion, pump 30 could be partially or fully controlled in other ways or through a redundancy system to assure that the activation time of pump 30 is minimized. One particular approach takes a look at signals from water level sensor 185. In this case, the cycling of pump 30 is regulated based on the water level in outer tub 25 of washing machine 2. Specifically, when the water level is sensed to be close to a bottom portion of inner tub 12, pump 30 is energized for a set amount of time. Therefore, pump 30 could also be cycled, even if the threshold speed requirement was not met, if the water level gets too high. In any case, it is preferable in accordance with the present invention to actually initiate the cycling of pump 30 when the water or washing solution comes close to or reaches the bottom of inner tub 12. This can be estimated to be at the time the upper spin speed is reached as fully described above, directly through water level sensor 185 or, in accordance with a still further modification, by monitoring the torque used to drive motor 27 through tub drive controls 182. That is, when the level of water reaches the bottom of the inner tub 12, the torque needed to spin inner tub 12 increases significantly. Sensing this sharp rise in torque signifies a need to initiate a drain operation and, in accordance with the invention, pump 30 is cycled instead of running full time. In any event, the reduced pump cycle time system in accordance with the invention is only intended to be limited by the scope of the following claims.

We claim:

1. A washing machine adapted to receive various articles of clothing to be laundered in an inner tub during a washing operation comprising:

a motor for rotating the inner tub;

a pump for draining the washing machine of at least water during a spin phase of the washing operation;

means for sensing when an operational parameter of the washing machine exceeds a threshold level during the spin cycle; and means for cycling the pump ON and OFF for a drainage operation based on the operational parameter exceeding the threshold level.

2. The washing machine according to claim 1, wherein the cycling means controls the pump with an OFF time which exceeds the ON time.

3. The washing machine according to claim 2, wherein the cycling means controls the pump to be ON for approximately 15 seconds and then OFF for approximately 30 seconds.

4. The washing machine according to claim 1, wherein the operational parameter is a speed at which the inner tub is rotated during the spin cycle.

5. The washing machine according to claim 1, wherein said cycling means initiates the drainage operation only after the operating parameter exceeds the threshold level for a predetermined time period.

6. The washing machine according to claim 5, wherein the predetermined time period is approximately 1 minute.

7. The washing machine according to claim 5, wherein the operational parameter is a speed at which the inner tub is rotated during the spin cycle.

8. The washing machine according to claim 7, wherein the speed is approximately 800 rpm.

9. The washing machine according to claim 1, wherein the cycling means deactivates the pump upon sensing a change in power to the pump.

10. The washing machine according to claim 1, wherein the operational parameter corresponds to a torque applied to rotate the inner tub by the motor during the spin cycle.

11. A method of operating a drain pump during a spin cycle in a washing machine comprising:

sensing a dynamic operational parameter of the washing machine;

determining when the operational parameter exceeds a threshold level during the spin cycle; and cyclically operating the drain pump when the operational parameter exceeds the threshold level.

12. The method of claim 11, further comprising: measuring a rotational speed of an inner tub of the washing machine as the dynamic operational parameter.

13. The method of claim 12, further comprising: verifying that the rotational speed remains above the threshold value for a predetermined time period before operating the drain pump.

14. The method of claim 13, further comprising: verifying that the rotational speed remains above the threshold value for approximately one minute before operating the drain pump.

15. The method of claim 14, further comprising: establishing the threshold level at approximately 800 rpm.

16. The method of claim 11, further comprising: cycling the drain pump for approximately 15 seconds ON and 30 seconds OFF.

17. The method of claim 11, further comprising:

sensing a change in power to the drain pump; and deactivating the drain pump when the change indicates that a combination of water and air is being pumped.

18. The method of claim 11, further comprising: sensing a torque applied to rotate an inner tub of the washing machine during the spin cycle; and controlling the drain pump based on variations in the torque.

* * * * *